US010207899B2

(12) United States Patent
Fauconnet et al.

(10) Patent No.: US 10,207,899 B2
(45) Date of Patent: Feb. 19, 2019

(54) FLEXIBLE MACHINE FRAME

(71) Applicant: Otis Elevator Company, Farmington, CT (US)

(72) Inventors: Aurelien Fauconnet, Isdes (FR); Frederic Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/968,528

(22) Filed: May 1, 2018

(65) Prior Publication Data

US 2018/0334361 A1 Nov. 22, 2018

(30) Foreign Application Priority Data

May 18, 2017 (EP) ..... 17305577

(51) Int. Cl.
*B66B 11/08* (2006.01)
*B66B 11/00* (2006.01)

(52) U.S. Cl.
CPC ..... *B66B 11/0035* (2013.01)

(58) Field of Classification Search
CPC B66B 11/0035; B66B 11/043; B66B 11/0438
See application file for complete search history.

(56) References Cited

U.S. PATENT DOCUMENTS 3,559,768 A * 2/1971 Cox ..... B66B 5/027 187/257
4,960,186 A * 10/1990 Honda ..... B66B 11/0438 187/254
6,367,587 B2 4/2002 Hakala et al.
6,405,833 B1 * 6/2002 Baranda ..... B66D 3/08 187/251
6,446,762 B1 9/2002 Pierre et al.
6,591,944 B2 * 7/2003 St. Pierre ..... B66B 7/06 187/250
6,601,828 B2 8/2003 Strbuncelj et al.
(Continued)

FOREIGN PATENT DOCUMENTS

EP 0565893 A2 10/1993
EP 1947049 A1 7/2008
WO 2015182772 A1 12/2015

OTHER PUBLICATIONS

Search Report dated Nov. 23, 2017 in EP Application No. 17305577, 6 pages.

*Primary Examiner* — Michael A Riegelman
(74) *Attorney, Agent, or Firm* — Cantor Colburn LLP

(57) ABSTRACT

A flexible elevator machine frame is provided. The flexible elevator machine frame includes a first end supportive of a motor, a second end supportive of a brake, a central portion and an adapter assembly. The central portion is interposable between the first and second ends and is configured to accommodate a base traction assembly between the motor and the brake. The central portion includes first and second end sides which are associated with the first and second ends, respectively, and which are configured to be fastened together. The adapter assembly is configured to be fastened between the first and second end sides to accommodate the base and an additional traction assembly between the motor and the brake.

14 Claims, 5 Drawing Sheets

(56) References Cited

U.S. PATENT DOCUMENTS

| | | | | |
|---|---|---|---|---|
| 6,663,086 | B2 * | 12/2003 | Huang | B66D 1/22 254/344 |
| 7,165,653 | B2 | 1/2007 | Rennetaud | |
| 7,624,847 | B2 | 12/2009 | Liebetrau et al. | |
| 8,302,740 | B2 | 11/2012 | Swaybill et al. | |
| 8,522,927 | B2 | 9/2013 | Fischer | |
| 8,631,907 | B2 | 1/2014 | Piech et al. | |
| 8,820,483 | B2 | 9/2014 | Ericson et al. | |
| 8,839,911 | B2 | 9/2014 | Hubbard et al. | |
| 8,960,418 | B2 * | 2/2015 | Rathmann | B65G 39/02 198/835 |
| 9,457,994 | B2 | 10/2016 | Piech et al. | |
| 2009/0078510 | A1 * | 3/2009 | Mueller | B66D 5/14 187/352 |
| 2009/0127949 | A1 * | 5/2009 | Zhang | B66B 11/0438 310/77 |
| 2015/0291395 | A1 | 10/2015 | Fargo et al. | |
| 2015/0353325 | A1 * | 12/2015 | Vincent | B66B 11/04 187/254 |
| 2018/0079625 | A1 * | 3/2018 | Fonteneau | B66B 9/00 |

* cited by examiner

FLEXIBLE MACHINE FRAME

CROSS REFERENCE TO RELATED APPLICATION

This patent application claims priority to European Patent Application Serial No. 17305577.3 filed May 18, 2017, which is incorporated herein by reference in its entirety.

DESCRIPTION

The following description relates to traction-drive elevator systems and, more particularly, to traction-drive elevator systems including flexible machine frames.

A traction-drive elevator system typically includes a car, a counterweight, two or more ropes interconnecting the car and the counterweight, one or more traction sheaves and grooves to move and guide the ropes and, thus, the car and counterweight and a machine to rotate the one or more traction sheaves. The machine may be either geared or gearless. In a geared machine, a gear train is used to achieve the desired output speeds and torque. In a gearless machine, the one or more traction sheaves is/are mounted directly to the output shaft of the motor.

Currently, a machine of a traction-drive elevator system can have one fixed configuration and arrangement from among a choice of multiple fixed configurations and arrangements. For example, a traction-drive elevator system can be provided such that the machine be formed to support two traction sheaves with two grooves and two ropes whereas another traction-drive elevator system can be provided such that its machine be formed to support three or four traction sheaves with three or four grooves and three or four ropes. The factors determining the type of machine needed for a given traction-drive elevator system is based on several parameters including, but not limited to, desired elevator speeds, elevator duty, weight, etc.

Whichever type of machine that is determined to be needed for a given traction-drive elevator system, that machine has a fixed configuration and arrangement. As such, machines of varying fixed configurations and arrangements need to be produced regardless of particular needs in order to be prepared to meet those needs when the time comes. Moreover, if the given traction-drive elevator system is modified such that the installed machine is no longer capable of support a sufficient number of traction sheaves and grooves, there is no way to simply modify that machine. Rather, it must be disassembled from the traction-drive elevator system and replaced.

According to one aspect of the disclosure, a flexible elevator machine frame is provided. The flexible elevator machine frame includes a first end supportive of a motor, a second end supportive of a brake, a central portion and an adapter assembly. The central portion is interposable between the first and second ends and is configured to accommodate a base traction assembly between the motor and the brake. The central portion includes first and second end sides which are associated with the first and second ends, respectively, and which are configured to be fastened together. The adapter assembly is configured to be fastened between the first and second end sides to accommodate the base and an additional traction assembly between the motor and the brake.

In accordance with additional or alternative embodiments, the adapter assembly is provided as a single, unitary part.

In accordance with additional or alternative embodiments, the adapter assembly is provided as multiple spacer elements disposable at multiple circumferential locations.

In accordance with additional or alternative embodiments, the adapter assembly is provided as upper and lower adapters.

In accordance with additional or alternative embodiments, one or more adapter assemblies are configured to be fastened between the first and second end sides to accommodate the base and one or more additional traction assemblies between the motor and the brake.

In accordance with additional or alternative embodiments, there is a 1:1 relationship between a number of the one or more adapter assemblies and a number of the one or more additional traction assemblies.

In accordance with additional or alternative embodiments, a number of the one or more adapter assemblies exceeds a number of the one or more additional traction assemblies.

In accordance with additional or alternative embodiments, a number of the one or more additional traction assemblies exceeds a number of the one or more adapter assemblies.

According to another aspect of the disclosure, a flexible elevator machine frame is provided. The flexible elevator machine frame includes a first end supportive of a motor, a second end supportive of a brake, a central portion and one or more adapter assemblies. The central portion is interposable between the first and second ends and configured to accommodate a base traction assembly between the motor and the brake. The base traction assembly includes a base number of traction sheaves and grooves. The central portion includes first and second end sides which are associated with the first and second ends, respectively, and which are configured to be fastened together. The one or more adapter assemblies are configured to be fastened between the first and second end sides to accommodate the base traction assembly and one or more additional traction assemblies between the motor and the brake. Each of the one or more additional traction assemblies includes additional traction sheaves and grooves.

In accordance with additional or alternative embodiments, each of the one or more adapter assemblies is provided as a single, unitary part.

In accordance with additional or alternative embodiments, each of the one of more adapter assemblies is provided as multiple spacer elements disposable at multiple circumferential locations.

In accordance with additional or alternative embodiments, each of the one or more adapter assemblies is provided as upper and lower adapters.

In accordance with additional or alternative embodiments, there is a 1:1 relationship between a number of the one or more adapter assemblies and a number of the one or more additional traction assemblies.

In accordance with additional or alternative embodiments, a number of the one or more adapter assemblies exceeds a number of the one or more additional traction assemblies.

In accordance with additional or alternative embodiments, a number of the one or more additional traction assemblies exceeds a number of the one or more adapter assemblies.

According to yet another aspect of the disclosure, a method of fabricating a flexible elevator machine frame is provided. The method includes forming a flexible elevator machine frame that includes a first end supportive of a motor, a second end supportive of a brake and a central portion interposable between the first and second ends and configured to accommodate a base traction assembly between the motor and the brake. The central portion includes first and second end sides which are associated with the first and second ends, respectively, and which are configured to be fastened together. The method further includes configuring an adapter assembly to be fastened between the first and second end sides to accommodate the base and an additional traction assembly between the motor and the brake.

In accordance with additional or alternative embodiments, the configuring of the adapter assembly includes configuring the adapter assembly as one of a single, unitary part, multiple spacer elements disposable at multiple circumferential locations and upper and lower adapters.

In accordance with additional or alternative embodiments, the configuring of the adapter assembly includes configuring one or more adapter assemblies to be fastened between the first and second end sides to accommodate the base and one or more additional traction assemblies between the motor and the brake.

In accordance with additional or alternative embodiments, there is a 1:1 relationship between a number of the one or more adapter assemblies and a number of the one or more additional traction assemblies, a number of the one or more adapter assemblies exceeds a number of the one or more additional traction assemblies or a number of the one or more additional traction assemblies exceeds a number of the one or more adapter assemblies.

In accordance with additional or alternative embodiments, the method further includes installing the flexible elevator machine frame including the central portion configured to accommodate only the base traction assembly in an elevator system, installing one or more additional traction assemblies between the motor and the brake, configuring one or more adapter assemblies for insertion into the central portion such that the central portion is configured to accommodate the base and the one or more additional traction assemblies and fastening the one or more adapter assemblies between the first and second end sides.

These and other advantages and features will become more apparent from the following description taken in conjunction with the drawings.

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

As will be described below, a machine for a traction-drive elevator system is provided to accommodate various numbers of traction sheaves and grooves for various applications. The machine includes a standard frame, which may be factory produced, for installation in the machine along with a brake and a motor such that the standard frame is supportive of the brake and the motor, and an adapter assembly. The adapter assembly is compatible with the standard frame and provides for machine modification capability. That is, if the machine with the standard frame is supportive of two traction sheaves and two grooves, the adapter assembly can be inserted into the frame such that the machine can be expanded to support three or more traction sheaves and three or more grooves.

Figure 1:
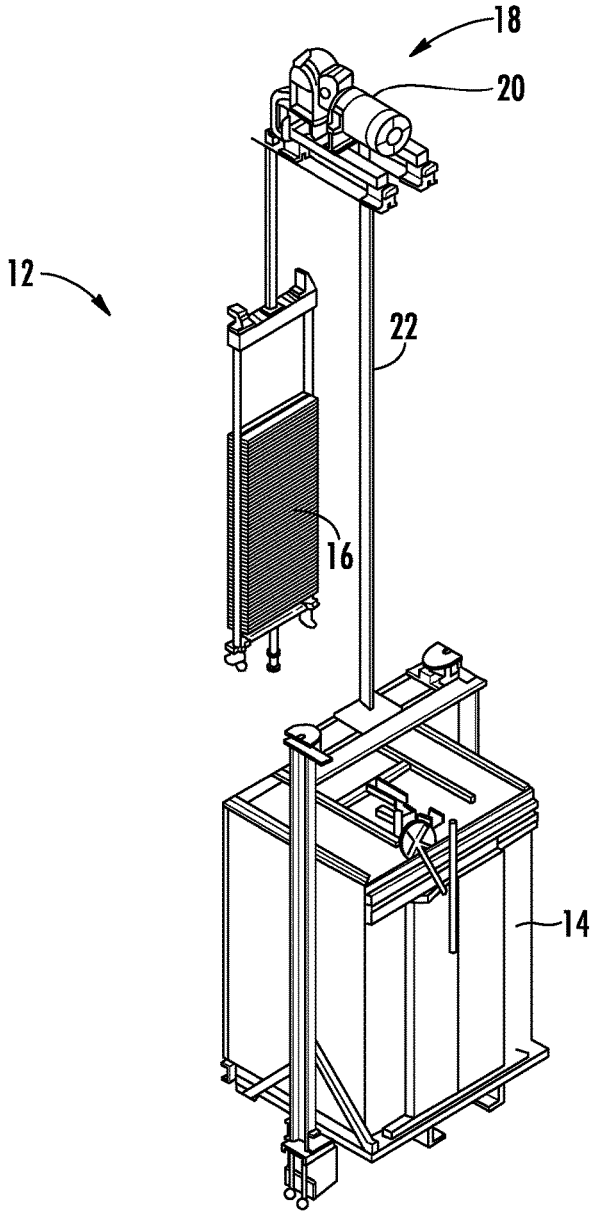
FIG. 1 is a perspective view of a traction-drive elevator system in accordance with embodiments.

With reference to FIG. 1, a traction-drive elevator system 12 is provided. The elevator system 12 includes a car 14, a counterweight 16, a traction drive section 18 and a machine 20 that is operably disposed in the traction drive section 18. The traction drive section 18 includes a tension member 22 that interconnects the car 14 and the counterweight 16. The tension member 22 rides over a traction sheave within a groove of the machine 20 as will be described below. The tension member 22 is engaged with the sheave such that rotation of the sheave moves the tension member 22 and thereby the car 14 and the counterweight 16. The machine 20 is engaged with the sheave to rotate the sheave.

Figure 2:
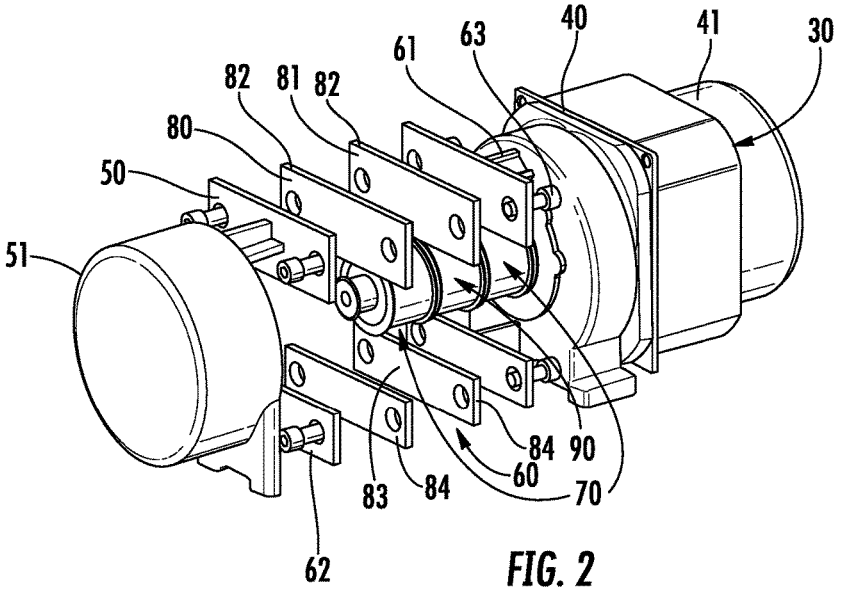
FIG. 2 is an exploded perspective view of a flexible elevator machine frame and an adapter assembly in accordance with embodiments.
Figure 3:
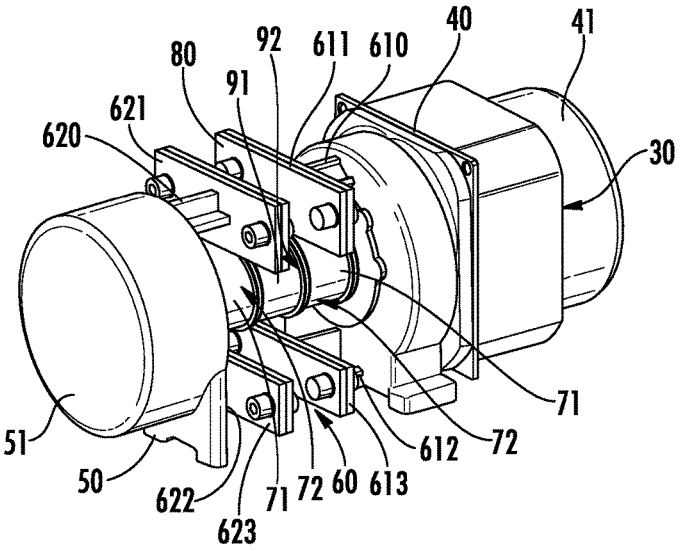
FIG. 3 is a perspective view of the flexible elevator machine frame and the adapter assembly of FIG. 2.

With reference to FIGS. 2 and 3, a flexible elevator machine frame 30 is provided for use with the machine 20 of FIG. 1 or another suitable machine. The flexible elevator machine frame 30 includes a first end 40 which is supportive of a motor 41, a second end 50 which is supportive of a brake 51 and a central portion 60. The central portion 60 is interposable between the first end 40 and the second end 50. The central portion 60 is configured to accommodate a base traction assembly 70 which is operably disposed between the motor 41 and the brake 51. The base traction assembly 70 has a base number of traction sheaves 71 and grooves 72. The central portion 60 includes a first end side 61 that is associated with the first end 40, a second end side 62 that is associated with the second end 50 and a fastener assembly 63 by which the first and second end sides 61 and 62 can be fastened together. The flexible elevator machine frame 30 further includes one or more adapter assemblies 80. The one or more adapter assemblies 80 are configured to be fastened between the first and second end sides 61 and 62 of the central portion 60 such that the central portion 60 can be made to accommodate the base traction assembly 70 and one or more additional traction assemblies 90 between the motor 41 and the brake 51. Each of the one or more additional traction assemblies 90 includes additional traction sheaves 91 and additional grooves 92.

During operations of the flexible elevator machine frame 10, a flat rope (see the tension member 22 of FIG. 1) is threaded through the flexible elevator machine frame 10 from a lower direction, over one of the traction sheaves 71 or the additional traction sheaves 91 and back toward the lower direction. The motor 41 is then activated to turn the base traction assembly 70 and, where applicable, the one or more additional traction assemblies 90 such that the flat rope translates and the corresponding car 14 and counterweight 16 (see FIG. 1) move upwardly and downwardly or vice versa. The brake 51 is provided to halt the turning in certain instances. The base traction assembly 70 and, where applicable, the one or more additional traction assemblies 90 are supportively disposed within the flexible elevator machine frame 10 by bearing assemblies that permit rotational couplings with the motor 41 and the brake 51.

Use of the one or more additional traction assemblies 90 is made when the number of the traction sheaves 71 and grooves 72 of the base traction assembly 70 is deemed insufficient for a given elevator system application. That is, if the base traction assembly 70 has two traction sheaves 71 and two grooves 72 such that it can support only two flat ropes where three flat ropes are actually needed, an additional traction assembly 90 with one additional traction sheave 91 and one additional groove 92 are added to the base traction assembly 70 (alternatively, the base traction assembly 70 with two traction sheaves and two grooves could be replaced with a larger traction assembly with three or more traction sheaves and three or more grooves to the same or a similar effect). In this case, the one or more adapter assemblies 80 are provided to effectively increase the capacity of the flexible elevator machine frame 10 to accommodate the one additional traction sheave 91 and the one additional groove 92.

Each of the traction sheaves 71 and the additional traction sheaves 91 may be formed as an annular or circular element with a substantially smooth exterior surface that can be coupled together to rotate as a single unit about a common rotational axis. Adjacent traction sheaves may, but are not required to, form a relatively small annular or circular flange that protrudes radially above the substantially smooth exterior surfaces. The grooves 72 and the additional grooves 92 are formed over the substantially smooth exterior surfaces and between sequential flanges. Thus, the flat rope can be securely seated within any one of the grooves 72 or the additional grooves 92.

In accordance with embodiments, the one or more adapter assemblies 80 may be formed at various positions along an axis of the central portion 60 and need not be aligned with the one or more additional traction assemblies 90. However, for the purposes of clarity and brevity, the following description will relate to the cases in which the one or more adapter assemblies 80 are formed at an axial midpoint of the central portion 60 and are aligned with the one or more additional traction assemblies 90.

As shown in FIGS. 2 and 3, the first and second end sides 61 and 62 may be formed to have similar structural features. The first end side 61 of the central portion 60 extends from an interior side of the first end 40 and includes an upper beam member 610 and a plate member 611 that is integrally coupled to a distal end of the upper beam member 610 as well as a lower beam member 612 and a plate member 613 that is integrally coupled to a distal end of the lower beam member 612. The upper and lower beam members 610 and 612 may have cross-shaped cross-sections or other suitable cross sections but need not have similar sizes or dimensions (besides, in some, but not all cases, having sufficient lengths to align the plate members 611 and 613 with the flanges of the traction sheaves). The lower beam member 612 must also be sufficiently small to avoid impeding the translation of the flat ropes. The plate members 611 and 613 may be substantially planar. The second end side 62 extends from an interior side of the second end 50 and includes an upper beam member 620 and a plate member 621 that is integrally coupled to a distal end of the upper beam member 620 as well as a lower beam member 622 and a plate member 623 that is integrally coupled to a distal end of the lower beam member 622. The upper and lower beam members 620 and 622 may have cross-shaped cross-sections or other suitable cross sections but need not have similar sizes or dimensions (besides, in some, but not all cases, having sufficient lengths to align the plate members 621 and 623 with the flanges of the traction sheaves). The lower beam member 622 must also be sufficiently small to avoid impeding the translation of the flat ropes. The plate members 621 and 623 may be substantially planar.

The fastener assembly 63 may be provided as a plurality of screw fasteners, adhesive or clamps that can be employed separately or in combination to fasten the plate members 621 and 623 to each other in the case of the flexible elevator machine frame 10 including only the base traction assembly 70.

As also shown in FIGS. 2 and 3, where a single adapter assembly 80 is provided between the first and second end sides 61 and 62 of the central portion 60, the adapter assembly 80 may include an upper beam member 81 and plate members 82 that are integrally coupled to opposite ends of the upper beam member 81 as well as a lower beam member 83 and plate member 84 that are integrally coupled to opposite ends of the lower beam member 83. The upper and lower beam members 81 and 83 may have cross-shaped cross-sections or other suitable cross sections but need not have similar sizes or dimensions (besides, in some, but not all cases, having sufficient lengths to align the plate members 82 and 84 with the flanges of the traction sheaves). The lower beam member 83 must also be sufficiently small to avoid impeding the translation of the flat ropes. The plate members 82 and 84 may be substantially planar.

As noted above, the fastener assembly 63 may be provided as a plurality of screw fasteners, adhesive or clamps that can be employed separately or in combination to fasten the plate members 82 to the plate members 611 and 621 and to fasten the plate members 84 to the plate members 613 and 623 in the case of the flexible elevator machine frame 10 including the base traction assembly 70 and a single additional traction assembly 90.

Figure 4:
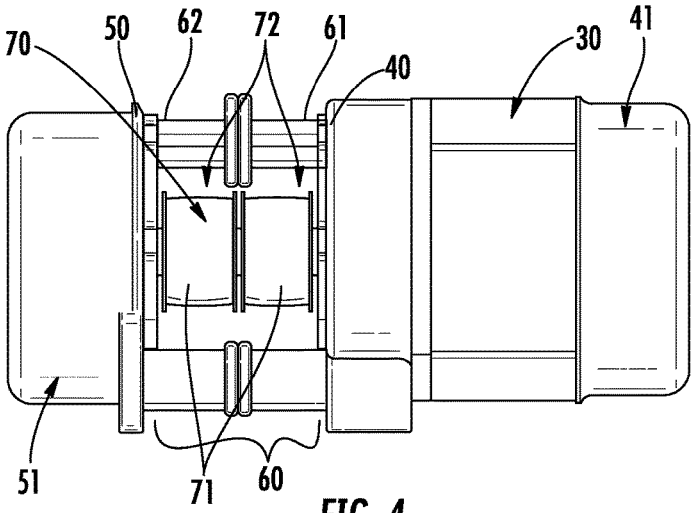
FIG. 4 is a side view of an operational condition of the flexible elevator machine frame of FIGS. 2 and 3.
Figure 5:
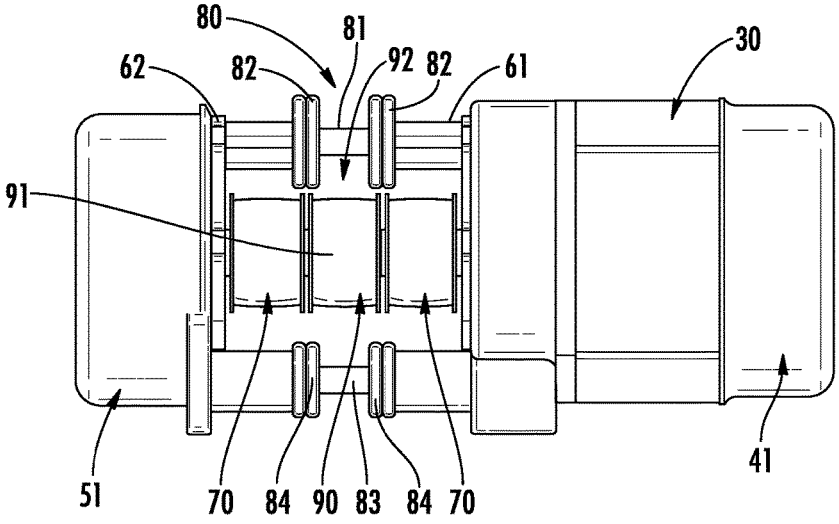
FIG. 5 is a side view of an operational condition of the flexible elevator machine frame and the adapter assembly of FIGS. 2 and 3.

With reference to FIGS. 4 and 5, a method of fabricating the flexible elevator machine frame 10 is provided. The method includes forming the flexible elevator machine frame 10 to include the first end 40 supportive of the motor 41, the second end 50 supportive of the brake 51 and the central portion 60 interposable between the first and second ends 40 and 50 and configured to accommodate the base traction assembly 70 between the motor 41 and the brake 51. The central portion 60 includes the first and second end sides 61 and 62 which are associated with the first and second ends 40 and 50, respectively, and which are configured to be fastened together. The method further includes configuring the adapter assembly 80 to be fastened between the first and second end sides 61 and 62 of the central portion 60 so as to accommodate the base traction assembly 70 and the additional traction assembly 90 between the motor 41 and the brake 51.

In addition, the method may include installing the flexible elevator machine frame 10 including the central portion 60 in a condition that it is configured to accommodate only the base traction assembly 70 in an elevator system (see FIG. 4). However, in an event that it is determined that the base traction assembly 70 is deemed insufficient, the method may further include installing one or more additional traction assemblies 90 between the motor 41 and the brake 51, configuring one or more adapter assemblies 80 for insertion into the central portion 60 such that the central portion 60 is configured to accommodate the base traction assembly 70 and the one or more additional traction assemblies 90 and fastening the one or more adapter assemblies 80 between the first and second end sides 61 and 62 (see FIG. 5).

Figure 6:
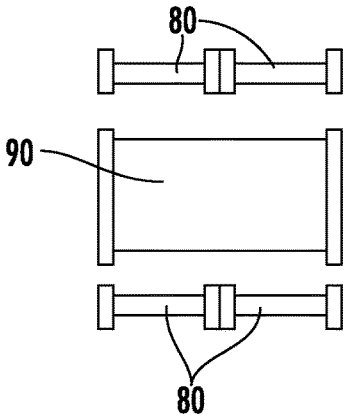
FIG. 6 is a schematic illustration of a number of adapter assemblies exceeding a number of traction sheaves and grooves in accordance with embodiments.
Figure 7:
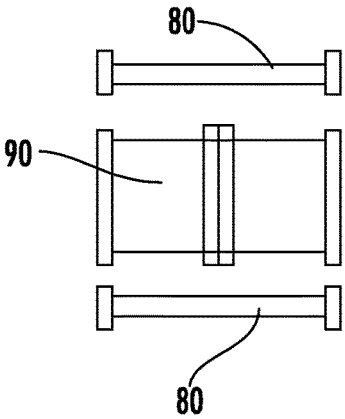
FIG. 7 is a schematic illustration of a number of traction sheaves and grooves exceeding a number of adapter assemblies in accordance with embodiments.

With reference to FIGS. 5, 6 and 7, there may be a 1:1 relationship between a number of the one or more adapter assemblies 80 and a number of the one or more additional traction assemblies 90 (see FIG. 5), a number of the one or more adapter assemblies 80 may exceed a number of the one or more additional traction assemblies 90 (see FIG. 6) or a number of the one or more additional traction assemblies 90 may exceed a number of the one or more adapter assemblies 80 (see FIG. 7).

Figure 8:
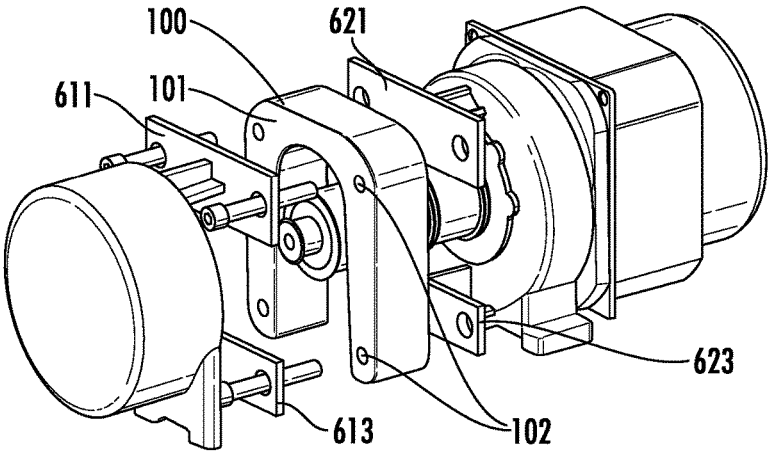
FIG. 8 is an exploded perspective view of a flexible elevator machine frame and an adapter assembly provided as a single, unitary part in accordance with embodiments.
Figure 9:
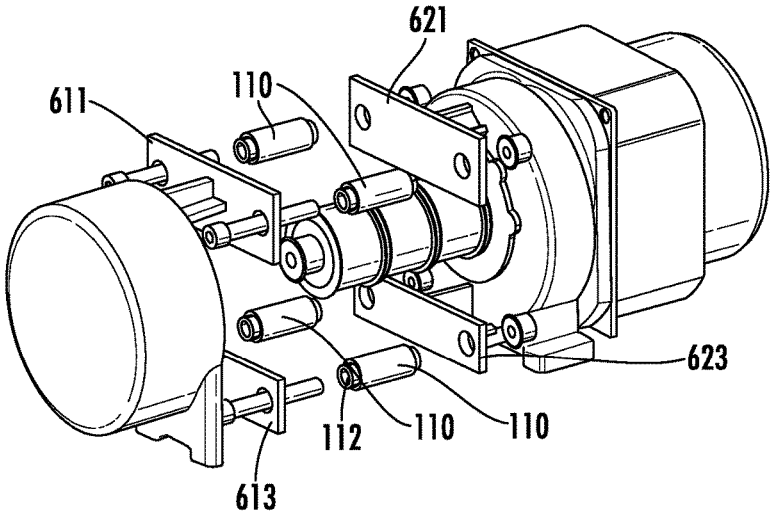
FIG. 9 is an exploded perspective view of a flexible elevator machine frame and an adapter assembly provided as multiple spacer elements in accordance with embodiments.

With reference to FIGS. 8 and 9, each of the one or more adapter assemblies may include a single, unitary part 100 (see FIG. 8), multiple spacer elements 110 that are disposable at multiple circumferential locations (see FIG. 9) or the upper and lower adapters of FIGS. 2-5. As shown in FIG. 8, the single, unitary part 100 may be provided as a body 101 that extends between the plate members 611 and 621 and between the plate members 613 and 623. The single, unitary part 100 extends partially about the rotational axis of the base traction assembly 70 and the additional traction assembly 90 and is formed to define through-holes 102 through which the screw fasteners extend. The single, unitary part 100 thus defines an aperture through which a flat rope can threadably extend into and out of the flexible elevator machine frame 10. As shown in FIG. 9, the multiple spacer elements 110 may be provided as individual bodies 111 that locally extend between the plate members 611 and 621 and between the plate members 613 and 623. The multiple spacer elements 110 are respectively formed to define through-holes 112 through which the screw fasteners extend.

With the addition of the adapter assembly to machine frames, it is expected that cost reductions and enhanced time to market factors will be realized. Such cost reductions will result from avoiding the need to cast and mold several machine frames. The time to market enhancement will come from the need to produce less moldings in order to launch a new design.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claime is:

1. A flexible elevator machine frame, comprising:

a first end supportive of a motor;

a second end supportive of a brake;

a central portion interposable between the first and second ends and configured to accommodate a base traction assembly between the motor and the brake, the central portion comprising first and second end sides which are associated with the first and second ends, respectively, and which are configured to be fastened together; and an adapter assembly configured to be fastened between the first and second end sides to accommodate the base and an additional traction assembly between the motor and the brake.

2. The flexible elevator machine frame according to claim 1, wherein the adapter assembly is provided as a single, unitary part.

3. The flexible elevator machine frame according to claim 1, wherein the adapter assembly is provided as multiple spacer elements disposable at multiple circumferential locations.

4. The flexible elevator machine frame according to claim 1, wherein the adapter assembly is provided as upper and lower adapters.

5. The flexible elevator machine frame according to claim 1, wherein one or more adapter assemblies are configured to be fastened between the first and second end sides to accommodate the base and one or more additional traction assemblies between the motor and the brake.

6. The flexible elevator machine frame according to claim 5, wherein there is a 1:1 relationship between a number of the one or more adapter assemblies and a number of the one or more additional traction assemblies.

7. The flexible elevator machine frame according to claim 5, wherein a number of the one or more adapter assemblies exceeds a number of the one or more additional traction assemblies.

8. The flexible elevator machine frame according to claim 5, wherein a number of the one or more additional traction assemblies exceeds a number of the one or more adapter assemblies.

9. The flexible elevator machine frame according to claim 1, wherein the base traction assembly comprises a base number of traction sheaves and grooves, and each of the one or more additional traction assemblies comprises additional traction sheaves and grooves.

10. A method of fabricating a flexible elevator machine frame, the method comprising:

forming a flexible elevator machine frame comprising a first end supportive of a motor, a second end supportive of a brake and a central portion interposable between the first and second ends and configured to accommodate a base traction assembly between the motor and the brake, the central portion comprising first and second end sides which are associated with the first and second ends, respectively, and which are configured to be fastened together; and configuring an adapter assembly to be fastened between the first and second end sides to accommodate the base and an additional traction assembly between the motor and the brake.

11. The method according to claim 10, wherein the configuring of the adapter assembly comprises configuring the adapter assembly as one of a single, unitary part, multiple spacer elements disposable at multiple circumferential locations and upper and lower adapters.

12. The method according to claim 10, wherein the configuring of the adapter assembly comprises configuring one or more adapter assemblies to be fastened between the first and second end sides to accommodate the base and one or more additional traction assemblies between the motor and the brake.

13. The method according to claim 10, wherein:

there is a 1:1 relationship between a number of the one or more adapter assemblies and a number of the one or more additional traction assemblies, a number of the one or more adapter assemblies exceeds a number of the one or more additional traction assemblies, or a number of the one or more additional traction assemblies exceeds a number of the one or more adapter assemblies.

14. The method according to claim 10, further comprising:

installing the flexible elevator machine frame comprising the central portion configured to accommodate only the base traction assembly in an elevator system;

installing one or more additional traction assemblies between the motor and the brake;

configuring one or more adapter assemblies for insertion into the central portion such that the central portion is configured to accommodate the base and the one or more additional traction assemblies; and fastening the one or more adapter assemblies between the first and second end sides.

* * * * *